United States Patent [19]

Fuchs et al.

[11] Patent Number: 5,044,282

[45] Date of Patent: Sep. 3, 1991

[54] TAPERED DISC AND JACKETED EXPLOSIVE DEVICE FOR PROJECTING HIGH VELOCITY METAL JETS

[75] Inventors: Brian Fuchs, Hackettstown; Barry Fishburn, Dover; Ernest L. Baker, Vernon, N.J.; Pai-Lien Lu, Rockaway, all of N.J.

[73] Assignee: The United States of America as represented by the Secretary of the Army, Washington, D.C.

[21] Appl. No.: 599,556

[22] Filed: Oct. 15, 1990

[51] Int. Cl.[5] ..... F42B 1/00

[52] U.S. Cl. ..... 102/475; 102/476

[58] Field of Search ..... 102/476, 501, 306, 307, 102/308, 309, 310, 475

[56] References Cited

U.S. PATENT DOCUMENTS

| | | | |
|---|---|---|---|
| 2,900,905 | 8/1959 | MacDougall | 102/476 |
| 3,561,361 | 2/1971 | Kennenich | 102/476 |
| 3,906,857 | 9/1975 | Rotondi | 102/476 |
| 4,170,940 | 10/1979 | Precoul | 102/476 |
| 4,896,609 | 1/1990 | Betts et al. | 102/476 |

*Primary Examiner*—Michael J. Carone

*Attorney, Agent, or Firm*—Anthony T. Lane; Edward Goldberg; Michael C. Sachs

[57] ABSTRACT

A cylindrical jacketed core explosive configuration with a circular tapered flyer plate operatively disposed in front of it produces a high velocity jet capable of penetrating hard materials. The charge assembly length is less than 1.4 times its diameter.

2 Claims, 1 Drawing Sheet

TAPERED DISC AND JACKETED EXPLOSIVE DEVICE FOR PROJECTING HIGH VELOCITY METAL JETS

GOVERNMENTAL INTEREST

The invention described herein may be manufactured, used and licensed by or for the Government for Governmental purposes without the payment to us of any royalty thereon.

BACKGROUND OF THE INVENTION

The present invention relates to an explosive device included in an armor-piercing type projectile for the purpose of producing a high velocity molten metal jet of great penetrating capability.

Various means have been used in the past to produce a "shaped charged" jet in an armor-piercing explosive. In present practice holes through heavy metal armor plates and other hard objects are frequently produced using lined cavities configured in an explosive. In these prior art shaped charges, the detonation of the explosive causes a liner to implode on an axis at verY high speed. The implosion, in turn, projects some of the liner material forward along the axis at even higher speed. This forward projecting material forms a jet of great penetrating power.

One of the problems with these prior art shaped charge devices was that the length of these explosive charges exceed 1.4 times their diameter by the nature of their design. In addition the liners require a certain degree of care in their manufacture to produce a suitable metal jet with sufficient velocity to penetrate the target.

The present invention is superior to the prior art shaped charge devices and method of explosively producing a metal penetrating jet because it only requires an easily fabricated metal disc with tapered edge. In addition, the present method utilizes a more compact explosive charge configuration than the prior art, and thus offers advantages of size as well as ease of manufacturing.

SUMMARY OF THE INVENTION

The present invention relates to an improved explosive charge for producing a shaped charge having a high velocity metal jet capable of punching holes through armor materials.

An object of the present invention is to provide explosive shaped char wherein the length of the charges is less than 1.4 times the diameter.

Another object of the present invention is to provide an explosive charge device which does not require a great deal of accuracy in manufacturing a metal liner.

Another object of the present invention is to provide an explosive charge having a jacketed explosive with a tapered metal disc in the front thereof which enables the present invention to be of more compact configuration than prior art shaped charges.

A further object of the present invention is to combine the high pressures obtainable from a cylindrical jacketed core explosive configuration with a circular flyer plate having tapered edges, to produce a high velocity jet of flyer plate material capable of penetrating armor materials.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DESCRIPTION OF THE PREFERRED EMBODIMENTS

Figure 1:
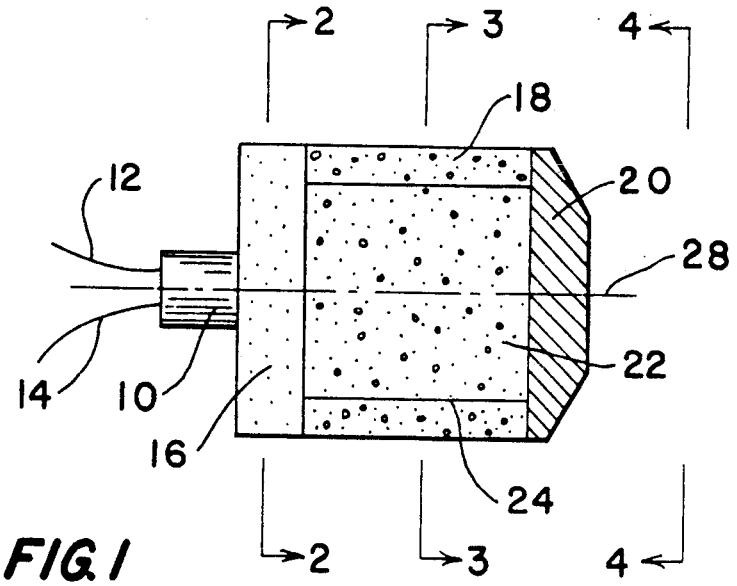
FIG. 1 is a longitudinal cross-sectional view of the tapered disc with jacketed explosive shaped charge.
Figure 2:
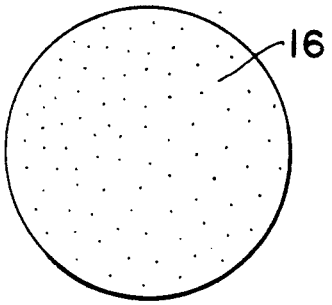
FIG. 2 is a cross-sectional view of an explosive booster charge taken along line 2—2 of FIG. 1.
Figure 3:
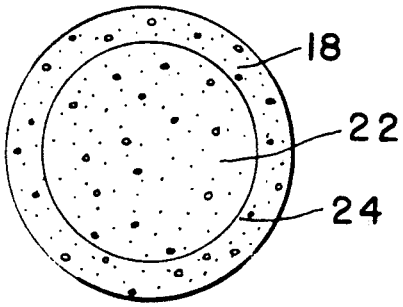
FIG. 3 is a cross-sectional view of a jacket explosive and a core explosive taken along line 3—3 of FIG. 1.
Figure 4:
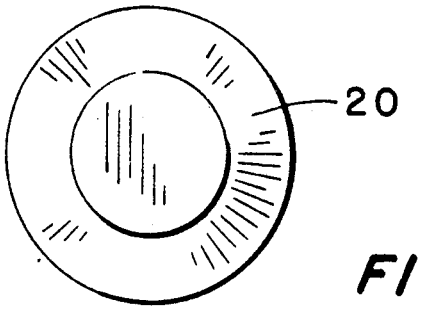
FIG. 4 is a front view of the tapered disc member taken along line 4—4 of FIG. 1.

Referring now to FIGS. 1-3, an electrical detonator 10, having electrical leads 12 and 14 operatively connected thereto, is axially disposed in juxtaposition with a cylindrical shaped explosive booster charge 16. An annular jacket explosive 18, having a diameter equal to the diameter of boostercharge 16, is axially positioned adjacent to the booster charge 16 and intermediate a circular flyer plate in the shape of a tapered disc 20. Within the annular space of the jacket explosive 18 is located a core explosive 22.

In operation, the detonation process of the explosive charge is initiated when an electrical impulse is applied to the electrical leads 12 and 14 from a voltage source, not shown. The detonator 10 activates the explosive booster 16 which in turn causes the jacket explosive charge 18 to explode. The jacket explosive 18 must have a higher detonation velocity than the core explosive charge 22 and must initiate the core explosive 22 along the cylindrical surface of contact 24. The core explosive charge 22 must have a lower Chapman-Jougnet detonation velocity than the jacket explosive charge 18. The core explosive 22 achieves a highly over-driven Mach stem detonation. Various combinations of explosives and charge diameters are possible to adjust the Mach stem detonation configuration and change its effect on the tapered disc 20. Mach stem detonation phenomena is well known in the literature and will not be discussed in detail in this disclosure other than to cite the following references:

1. B. Fuchs, E. Baker, E. Dalrymple, P. Lu, "Measuring Detonation Front Configuration via Flash Radiography and Ultra-high Speed Photography," SPIE 31st Annual International Technical Symposium On Optical and Optoelectronic Applied Science and Engineering, San Diego, Calif., 1987.
2. E. Baker, B. Fishburn, B. Fuchs, P. Lu, "Formation and Structure of Axissymmetric Steady-State Detonation Mach Stems in Condensed Explosive," Journal of Energetic Materials, vol. 5, 239-256, 1987.
3. E. Baker, E. Dalrymple, B. Fishburn, B. Fuchs, J. Howell, P. Lu, "Axissymmetric Steady-State Detonation Mach Stem and Semi-infinite Steel Witness Plate Interaction," Picatinny Arsenal (to be published).

The tapered disc 20 is placed against the front of the jacketed core explosive charge 18 and 22. The taper 26 extends from the outer edge of the jacket explosive 18 to the diameter of the central Mach stem region of the impacting detonation wave, which will be smaller than the core explosive 22 itself. At the completion of the detonation, a penetrating jet of disc material is launched along the charge axis 28 forward of the tapered disc 20, at speeds in excess of 5 km/sec.

While a specific embodiment of the invention has been shown and described in detail to illustrate the application of the principles of the invention, it will be understood that the invention may be embodied otherwise without departing from such principles.

What is claimed is:

1. An apparatus for producing a shaped charge which comprises:

detonator means for initiating an explosive charge:

booster charge means operatively disposed in juxtaposition with said detonator means and capable of being explosively activated by said detonator means;

jacket explosive means disposed adjacent to and in axial alignment with said booster charge means for being explosively activated by said booster charge means and for generating high detonation velocities;

core explosive means axially disposed within said jacket explosive means for generating a Chapman-Jougnet detonation velocity lower than the detonation velocity of said jacket explosive means and for achieving a highly over driven Mach stem detonation; and disc means operatively disposed against said jacket and core explosive means for interacting with the Mach stem detonation of said core explosive means to produce a penetrating jet of disc material, including a tapered circular flyer plate disc having a taper extending from the outer edge of said jacket explosive annular configuration to the diameter of a central Mach stem region of an impacting detonation wave, which will be smaller than the diameter of said core explosive.

2. An apparatus as described in claim 1 wherein the length of said booster charge, jacket explosive and core explosive assembly is less than 1.4 times the diameter of the assembly.

* * * * *